US005664000A

United States Patent [19]

Van Woezik et al.

[11] Patent Number: 5,664,000

[45] Date of Patent: Sep. 2, 1997

[54] X-RAY EXAMINATION APPARATUS COMPRISING AN EXPOSURE CONTROL CIRCUIT

[75] Inventors: Johannes T.M. Van Woezik; Paulus H.F.M. Van Twist, both of Eindhoven, Netherlands

[73] Assignee: U.S. Philips Corporation, New York, N.Y.

[21] Appl. No.: 575,796

[22] Filed: Dec. 22, 1995

[30] Foreign Application Priority Data

Dec. 23, 1994 [EP] European Pat. Off. ..... 94203754

[51] Int. Cl.[6] ..... H05G 1/64

[52] U.S. Cl. ..... 378/98.7; 378/95; 378/112

[58] Field of Search ..... 378/95, 98.2, 98.7, 378/108, 109, 110, 111, 112, 151

[56] References Cited

U.S. PATENT DOCUMENTS

| | | | |
|---|---|---|---|
| 4,562,586 | 12/1985 | Honda et al. | 378/108 |
| 4,868,651 | 9/1989 | Chou et al. | 378/98.7 |
| 4,982,418 | 1/1991 | Kuehnel | 378/95 |
| 5,012,504 | 4/1991 | McFaul et al. | 378/108 |
| 5,029,338 | 7/1991 | Aichinger et al. | 378/98.7 |
| 5,144,646 | 9/1992 | Gerlach | 378/98.7 |
| 5,287,396 | 2/1994 | Stegehuis | 378/98.2 |
| 5,388,138 | 2/1995 | Fujiwara | 378/108 |
| 5,485,501 | 1/1996 | Aichinger | 378/98.7 |

FOREIGN PATENT DOCUMENTS 2610845 9/1977 Germany .

*Primary Examiner*—David P. Porta
*Attorney, Agent, or Firm*—Jack D. Slobod

[57] ABSTRACT

An X-ray examination apparatus includes an exposure control circuit (20) which supplies a control signal for adjustment of the X-ray source (1). The exposure control circuit (20) determines the control signal from an area of the X-ray image in which no overexposure occurs. To this end, the exposure control circuit includes a selection unit (23) for determining a measuring part from an electronic image signal, formed from the X-ray image by means of an X-ray detector (5, 8, 7), by comparing the signal level of the electronic image signal with an upper limit value which is dependent on the setting of the X-ray apparatus, for example of the high voltage and the anode current of the X-ray source. The upper limit value preferably amounts to the difference between the overexposure level and a safety margin. The safety margin serves to render the exposure control circuit insensitive to small fluctuations of the intensity and energy of the X-ray beam (3) generated by the X-ray source (1).

20 Claims, 2 Drawing Sheets

X-RAY EXAMINATION APPARATUS COMPRISING AN EXPOSURE CONTROL CIRCUIT

BACKGROUND OF THE INVENTION

1. Field of the Invention

The invention relates to an X-ray examination apparatus, including an X-ray source for emitting an X-ray beam in order to form an X-ray image of an object, an X-ray detector for detecting the X-ray image and converting it into an electronic image signal, and an exposure control circuit for forming a control signal from the electronic image signal in order to adjust the X-ray source. The invention also relates to a method of controlling, by way of feedback, an X-ray source which irradiates an object, thus forming an X-ray image wherefrom an electronic image signal is formed wherefrom a control signal is derived for controlling the X-ray source.

2. Description of the Related Art

An X-ray examination apparatus of this kind is known from German Auslegeschrift DE 26 10 845.

The known X-ray examination apparatus comprises a selector switch for selecting one of six predetermined measuring fields in the X-ray image. The control signal is the mean value of the brightness of the X-ray image within the selected measuring field. It is used in a feedback loop to control the power supply unit of the X-ray source, thus controlling the duration of exposure of a patient to be examined so as to achieve adequate brightness and contrast in the X-ray image and to limit the X-ray dose. In the case of overexposure, in the known X-ray apparatus the control signal is affected by a contribution made by an overexposed area within the measuring field selected in the X-ray image. Overexposure occurs whenever substantially non-attenuated X-rays are incident on the X-ray detector, for example because such X-rays have passed adjacent the patient or through a low-absorption part of the patient. Due to contributions of overexposed areas to the control signal, the exposure control circuit of the known X-ray examination apparatus produces a setting which is detrimental to the image quality in areas of the X-ray image outside the overexposed area. Due to the presence of an overexposed area within the selected measuring field, it may occur, for example that the mean brightness in the measuring field is higher than the brightness in an area of the measuring field in which an anatomical structure which is of importance for the examination is reproduced. In such a case the exposure control circuit produces a control signal whereby the X-ray source is controlled so that the mean brightness in the measuring field is adjusted to a desired value, but the brightness in the area with the anatomic structure will then be lower than the brightness required for a suitable reproduction of this anatomical structure is obtained.

SUMMARY OF THE INVENTION

It is an object of the invention to provide an X-ray examination apparatus which includes an exposure control circuit whereby adverse effects on the setting of the X-ray source due to an overexposed area of the X-ray image are counteracted.

This object is achieved by means of an X-ray examination apparatus in accordance with the invention which is characterized in that the exposure control circuit is arranged to determine a non-overexposed area of the X-ray image in which brightness values are mainly lower than an upper limit value and to derive the control signal from the non-overexposed area.

Because brightness values in overexposed areas exceed the upper limit value, so that these areas are excluded from the determination of the control signal, contributions of overexposed areas to the control signal are counteracted. As a result, mainly an area of the X-ray image in which no very high brightness values occur contributes to the control signal. The control signal is derived from image information in the X-ray image which can mainly be suitably reproduced; an overexposed area has such a high brightness that, in as far as it contains image information, this image information cannot be suitably reproduced. Because the control signal is related mainly to image information, the X-ray source is adjusted so that image information in the X-ray image can be reproduced with a high diagnostic quality.

The more areas of the X-ray image with brightness values in excess of the upper limit value are excluded from contributing to the control signal, the less overexposed areas can affect the control signal.

The X-ray detector is, for example an image intensifier pick-up chain which includes an X-ray image intensifier with an image pick-up apparatus in the form of a television camera. The X-ray detector may also be an X-ray sensitive semiconductor detector deriving an electronic image signal from the X-ray image. Such an X-ray detector, for example may be provided with an X-ray-sensitive selenium layer in which an electric charge pattern is formed by local absorption of X-rays, which pattern is converted into an electronic image signal by scanning. The X-ray detector may also be an image detector comprising photosensitive α-Si elements covered with a scintillation layer. The scintillation layer converts the incident X-rays into light whereto the α-Si elements are sensitive; these elements convert the light into the electronic image signal.

A preferred embodiment of an X-ray examination apparatus in accordance with the invention, in which the X-ray detector comprises an X-ray image intensifier with an entrance screen and an exit window for convening the X-ray image on the entrance screen into an optical image on the exit window, and an image pick-up apparatus for deriving the electronic image signal from the optical image, is characterized in that the exposure control circuit is arranged to derive the control signal from an area of the optical image in which substantially no overexposure occurs.

The X-ray image intensifier converts the X-ray image into an optical image of visible light or ultraviolet or infrared radiation. Overexposed areas of the X-ray image on the entrance screen are converted into overexposed areas in the optical image on the exit window. Such an overexposed area has a very high brightness, so that image information cannot be suitably reproduced, for example because the image pick-up apparatus cannot process such high brightness values without being disturbed. Brightness values in the optical image are measured and on the basis of the measuring result an area of the optical image is determined in which overexposure does not occur. In this version of the invention, areas of the optical image in which overexposure occurs are not taken into account for deriving the control signal. As more overexposed areas in the optical image are excluded, the control signal is affected less by overexposures in the X-ray image.

A further preferred embodiment of an X-ray examination apparatus in accordance with the invention is characterized in that the exposure control circuit comprises a selection unit for selecting a measuring part from the electronic image signal by selection of a part of the electronic image signal which has a signal level below a limit value.

The limit value is determined in advance, for example experimentally or by calculation, so that it is below the signal level of the part of the electronic image signal which relates to the overexposed area of the X-ray image. The signal level of a part of the electronic image signal which concerns a pixel of the X-ray image represents the brightness of that pixel. A signal level higher than the limit value in the electronic image signal corresponds to a brightness in excess of the upper limit value in the X-ray image. The control signal is derived from the measuring part which, at least for the best part, does not relate to the overexposed area in the X-ray image, so that the contribution of such an overexposed area to the control signal is limited.

A further preferred embodiment of an X-ray examination apparatus in accordance with the invention is characterized in that the exposure control circuit comprises an averaging unit for determining a mean signal level of the measuring part, which averaging unit comprises an input which is coupled to an output of the selection unit and an arithmetic unit for forming the control signal as a function of the difference between a reference value and said mean signal level.

When the X-ray source is adjusted by means of this control signal, an X-ray image is formed whose small low-contrast details in the non-overexposed area can still be reproduced in a suitably visible manner. For example, this is achieved in that the brightness in the non-overexposed area suitably corresponds to a range in which the image pick-up apparatus sensitivity is optimum. The control signal adjusts the X-ray source on the basis of the mean brightness in an area of the X-ray image in which no or hardly any overexposure occurs. Because the control signal is derived from the mean brightness in an area of the X-ray image which is substantially free from overexposure, the effects of noise in the X-ray image on the control signal are also counteracted.

A further preferred embodiment of an X-ray examination apparatus in accordance with the invention is characterized in that for individual settings of the X-ray apparatus the upper limit value equals an overexposure level minus a safety margin.

The overexposure level is the brightness in the X-ray image in a position in which substantially non-attenuated X-rays are incident. This overexposure level is dependent on the settings of the X-ray source and/or the X-ray detector. Because said upper limit value is dependent on the setting of the X-ray examination apparatus, the determination of the control signal takes into account the fact that overexposed areas in the X-ray image are liable to change when the setting of the X-ray apparatus is changed. The safety margin ensures that the exclusion of overexposed areas is substantially independent of comparatively small, unintentional fluctuations of the energy and intensity of the X-rays. A suitable safety margin amounts to approximately half the intensity of the X-ray source on the X-ray detector, measured without an object being present in the X-ray beam.

A further preferred embodiment of an X-ray examination apparatus in accordance with the invention is characterized in that the exposure control circuit is arranged to determine the ratio of the surface area of the non-overexposed area to the surface area of the entire X-ray image in order to compare this ratio with a boundary value and to adjust the control signal to a value corresponding to a low brightness of the X-ray image if the fraction does not exceed the boundary value.

If the surface area of the non-overexposed area relative to the surface area of the entire X-ray image is below the boundary value, the control signal is nevertheless not determined from such a small non-overexposed area. In order to prevent the formation of a control signal on the basis of a rather small part of the X-ray image, the control signal is first delivered so as to adjust the X-ray source in such a manner that an X-ray image of low brightness is formed and the overexposed area is substantially reduced. After the overexposure has been reduced, the control signal is further adjusted on the basis of mainly non-overexposed areas in the X-ray image.

Another preferred embodiment of an X-ray examination apparatus in accordance with the invention is characterized in that the exposure control circuit comprises an edge detector for detecting an edge of the overexposed area and for supplying an edge signal which indicates the location of said edge in the X-ray image in order to control an image processing system for the processing of the electronic image signal and/or to control a beam diaphragm arranged between the X-ray source and the X-ray detector.

The determination of a non-overexposed area in the X-ray image in order to derive the control signal therefrom, also reveals the location of overexposed areas in the X-ray image. To one side of an edge of an overexposed area in the X-ray image there are found mainly brightness values occur which are below the upper limit value whereas to the other side of said edge there are found mainly brightness values in excess of said upper limit value.

Using the edge signal, indicating the location of such an edge in the X-ray image, the beam diaphragm can be controlled so as to intercept a part of the X-ray beam which would cause overexposure, thus reducing the X-ray dose whereto the patient is exposed. An image processing unit can be controlled by means of the edge signal so as to omit parts of the electronic image signal which correspond to overexposed areas in the X-ray image or to replace such parts by a signal level for a fixed neutral grey or color value. In a rendition of the X-ray image obtained by means of an electronic image signal thus processed, the reproduction of overexposed areas does not distract the attention, so that the rendition has a higher diagnostic quality. Furthermore, on the basis of the edge signal the image processing system can perform automatic adaptation of the brightness and contrast in a rendition of the non-overexposed areas of the X-ray image so as to achieve an optimum distribution of the brightness values in said rendition. Control of the beam diaphragm and/or the image processing system on the basis of the control signal enables automatic control when the X-ray image changes; an operator of the X-ray examination apparatus need then pay hardly any attention to adjusting the beam diaphragm and the image processing system.

In a contemporary X-ray examination apparatus in accordance with the invention, the various exposure control functions can be executed by a suitably programmed computer or by a special-purpose electronic processor.

It is another object of the invention to provide a method of controlling an X-ray source in order to form an X-ray image in which disturbances caused by an X-ray image area which does not contain relevant image information are counteracted.

To achieve this, a method in accordance with the invention is characterized in that the control signal is derived mainly from an area of the X-ray image in which brightness values are below an upper limit value. Because brightness values exceed the upper limit value in overexposed areas, contribution of overexposed areas to the control signal are counteracted.

BRIEF DESCRIPTION OF THE DRAWING

These and other aspects of the invention will be apparent from and elucidated with reference to the embodiments described hereinafter, and with reference to the accompanying drawing in which.

DETAILED DESCRIPTION OF THE PREFERRED EMBODIMENTS

Figure 1:
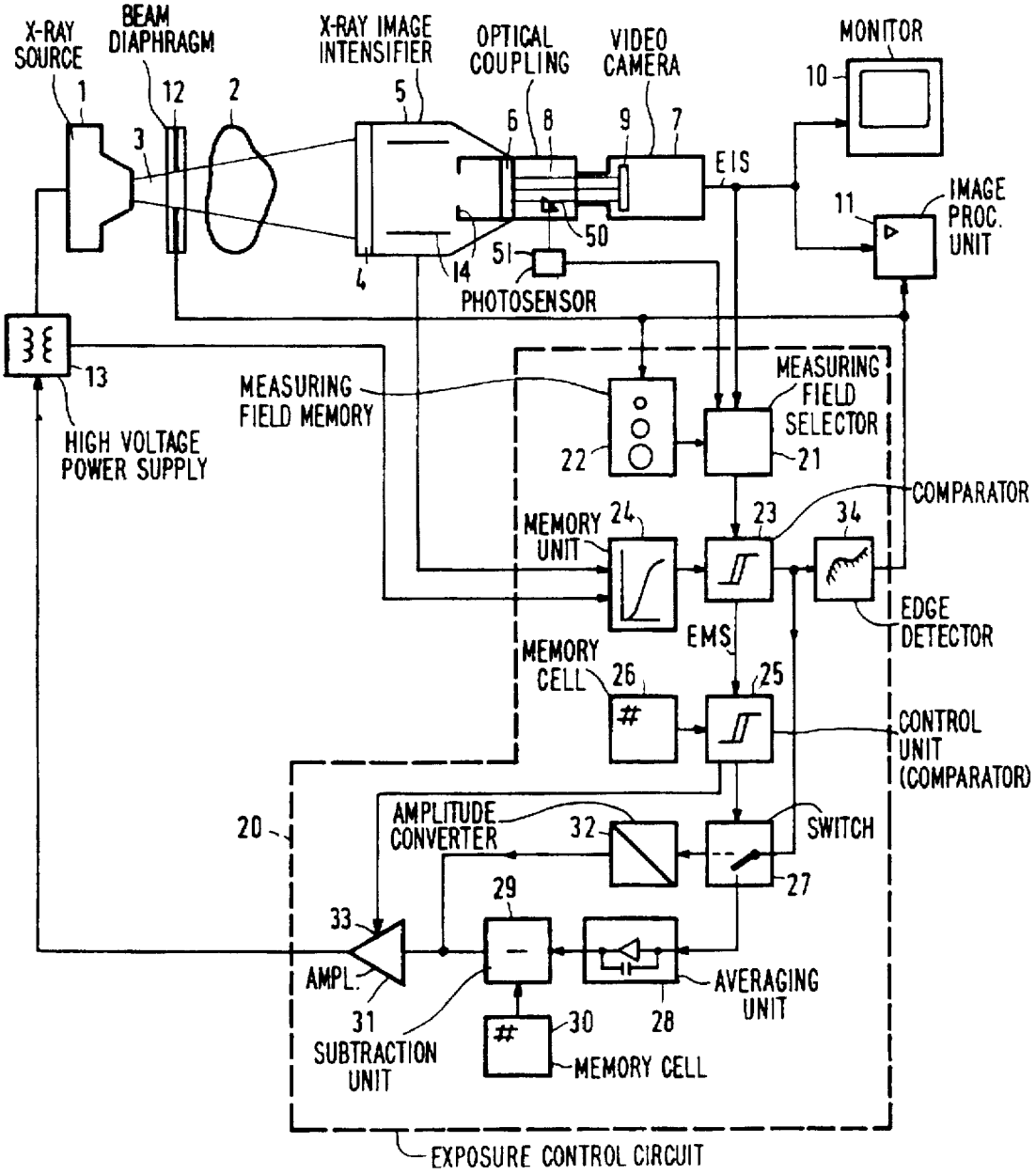
FIG. 1 is a diagrammatic representation of an X-ray examination apparatus in accordance with the invention.

FIG. 1 is a diagrammatic representation of an X-ray examination apparatus in accordance with the invention. The X-ray source 1 irradiates an object 2, for example a patient to be examined, by means of the X-ray beam 3 and local differences in the X-ray absorption within the object produce an X-ray image on the entrance screen 4 of an X-ray image intensifier 5 which x-ray image is convened into an optical image on the exit window 6. A video camera 7 is coupled to the X-ray image intensifier 5, via an optical coupling 8, in order to pick up the optical image on the exit window 6 and to form the electronic image signal therefrom. The optical coupling is formed, for example by a lens system which images the exit window on an image sensor 9 of the video camera. The electronic image signal EIS is applied, for example to a monitor in order to display the information of the X-ray image on a monitor 10, or to an image processing system 11 for further processing.

The electronic image signal EIS is also applied to the exposure control circuit 20. Using a measuring field selector 21, first a part relating to a, for example approximately circular central measuring field in the X-ray image is separated from the electronic image signal. It is thus counteracted that the control signal supplied by the exposure control signal is disturbed by parts at the edge of the X-ray image, for example by the imaging of lead slats of the beam diaphragm 12. Various measuring fields of different diameter or shape can be chosen from a measuring field memory 22 in conformity with the type of X-ray examination whereto the patient is subjected. For example, the measuring field is also chosen on the basis of the setting of the beam diaphragm 12, preferable to ensure that the separated part of the electronic image signal practically does not relate to the image of the lead slats. A comparator 23 compares the electronic image signal on the output of the measuring field selector with the limit value applied to the comparator by a memory unit 24 in conformity with the instantaneous setting of the X-ray examination apparatus.

The limit value is stored in the memory unit 24 as a function of the setting of the X-ray examination apparatus, for example in the form of a table containing the limit value for different values of the high voltage and/or the anode current of the X-ray source. A signal level in excess of the limit value in the electronic image signal corresponds to a brightness in the X-ray apparatus which exceeds the upper limit value; this upper limit value equals the brightness value occurring in the absence of an object in the beam minus the safety margin. It has been found that good results are obtained when the safety margin amounts to approximately half the brightness value obtained in the absence of an object in the beam. The upper limit value may also be dependent on the high voltage of the electron-optical system 14 of the X-ray image intensifier 5.

The measuring part EMS of the electronic image signal is available on an output of the comparator 23 by selection of the part of the signal on the output of the measuring field selector which has a signal level below the limit value.

Figure 2:
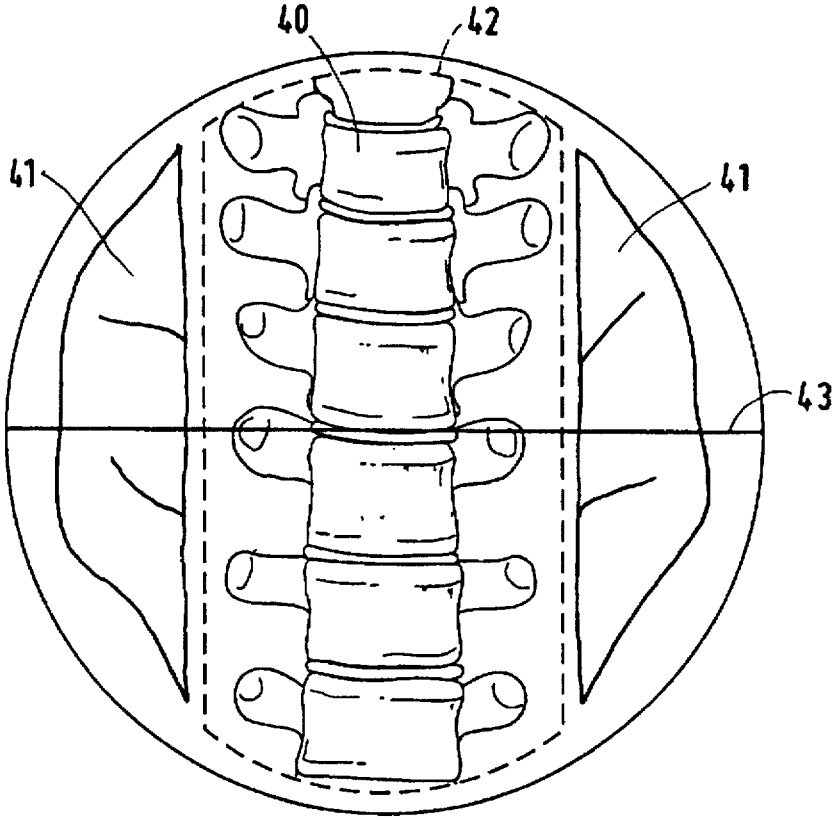
FIG. 2 is a rendition of an X-ray image containing overexposed areas.

FIG. 2 is a diagrammatic rendition of an X-ray image containing overexposed areas. A shadow image of a vertebral column 40 is diagrammatically represented in the image. For suitable imaging of the vertebral column, use is made of comparatively intense X-rays which are hardly absorbed by the lung tissue adjacent the vertebral column. Therefore, overexposed areas 41 occur in the X-ray image, viz. the part of the X-ray image in which the lungs are imaged. The control signal is derived from a non-overexposed area 42 which contains mainly image information of the vertebral column, so that the X-ray source is adjusted in such a manner that the image of the vertebral column is suitably reproduced.

Figure 3:
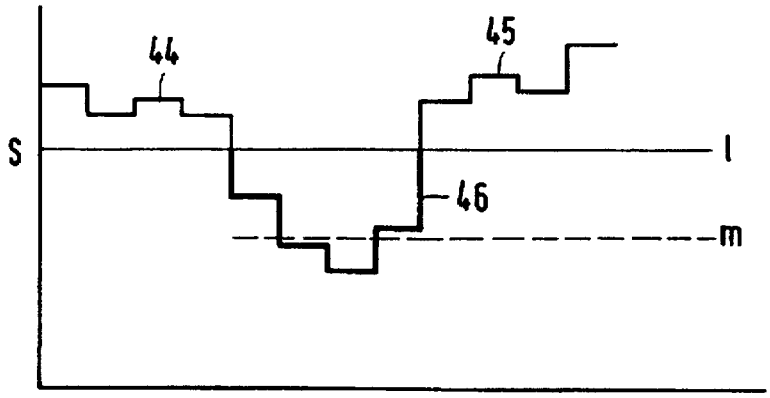
FIG. 3 is a graphic rendition of a part of the electronic image signal associated with the X-ray image of FIG. 2.

FIG. 3 is a graphic representation of a part of the electronic image signal associated with the X-ray image of FIG. 2. More specifically, FIG. 3 shows the signal level of the electronic image signal of an image line 43 in the image of FIG. 2. In the parts 44, 45 of the electronic image signal relating to the overexposed area 41 the signal level is higher than the limit value l. In the part 46 of the electronic image signal relating to the non-overexposed area 42, the signal level is below the limit value. The measuring part of the electronic image signal is formed from parts of a signal level below the limit value of the electronic image signals of the image lines of the X-ray image. From this measuring part the control signal is derived with a signal level which amounts to the mean signal level m of the measuring part.

Reference is made to FIG. 1 for a further description of the X-ray examination apparatus in accordance with the invention. The measuring part of the electronic image signal is applied to a control unit 25 which compares the ratio of the surface area whereto the measuring part in the X-ray image corresponds to the surface area of the X-ray image, or the surface area of the selected measuring field with a boundary value. The boundary value is stored in a memory cell 26. On the basis of this comparison, the control unit 25, for example in the form of a second comparator, controls a switch 27. If the ratio exceeds the boundary value, the measuring part of the electronic image signal on the output of the comparator is applied to an averaging unit 28 which forms a mean signal having a signal level which is the mean signal level of the measuring part of the electronic image signal. As an alternative for the mean signal, use can be made of a signal representing another quantity representing an aspect of the brightness distribution in the X-ray image. Examples of such a quantity are the maximum, the median value, the modal value, the fraction of brightness values which exceed a predetermined fixed threshold, etc. The reference value, stored in a memory cell 30, is subtracted from said mean signal in a subtraction unit 29, so that the output of the subtraction unit 29 supplies a difference signal which is applied, after amplification by an amplifier 31, to the high voltage power supply as a control signal. The reference value stored in the memory cell 30 is a signal amplitude of the control signal which corresponds to the mean brightness of a medically diagnostically relevant area of the X-ray image with which the image information in said area can be clearly reproduced, for example in the image formed on the monitor 10 or in the image of a hard copy of the image information produced in the image processing system. The difference signal, and hence also the control signal, is decisive as regards the deviation between the actual brightness and the desired brightness in the area of the X-ray image which contains diagnostically relevant image information. If the ratio is below the boundary value, the measuring part of the electronic image signal corresponds to a very small pan of the X-ray image or of the selected measuring field. When the measuring part of the electronic image signal relates to less than, for example 5% of the surface area of the X-ray image, the measuring part of the electronic image signal is converted into a signal of predetermined signal amplitude by a converter 32. After amplification by the amplifier 31, this signal is applied to the high voltage power supply 13 as a control signal for readjustment of the X-ray source 1 by adjusting it, for example to a lower intensity and energy of the X-ray beam, so that fewer overexposed areas occur in the X-ray image.

As a result of the exclusion of overexposed areas in the X-ray image, the exposure control circuit supplies a control signal for automatically adjusting the high voltage power supply 13 so as to reproduce medically relevant image information in the X-ray image as well as possible. For example, when an X-ray image is formed of the vertebral column of a patient, overexposed areas occur adjacent the shadow image of the vertebral column, because tissue which contains mainly air, such as lung tissue, transmits X-rays substantially without attenuation. Because the overexposed areas do not have an effect on the control signal, the high voltage power supply is adjusted by the control signal in such a manner that an X-ray image is formed in which the area containing the vertebral column can be suitably reproduced. When subsequently an X-ray image of the area of the lungs is made, the position of the patient is changed relative to the X-ray beam in such a manner that mainly the lungs are irradiated and no more than only a small part of the vertebral column at the edge of the X-ray image is reproduced. In such a case large areas of the X-ray image are overexposed and the area of the X-ray image whereto the measuring part of the electronic image signal relates drops below the boundary value. The control unit 25 then switches over the switch 27 so as to convert, via the converter 32, the measuring part of the electronic image signal into said signal of predetermined signal amplitude. This signal is amplified by the amplifier 31 and applied to the high voltage power supply 13 as a control signal for readjusting the X-ray source 1 to such a low intensity and energy that the lung tissue is reproduced in the X-ray image without overexposure. The control unit also acts on a control input 33 of the amplifier 31 in order to apply a gain factor which, when the X-ray source is readjusted by means of an amplified signal from the converter 32, is higher than in the case of a signal supplied by the subtraction unit 29. As a result of the higher gain factor, excessive readjustment periods for the X-ray source are avoided, for example in the present case for imaging the lung tissue. As a result of the use of the higher gain factor for readjustment the X-ray source from a situation in which large areas in the X-ray image are overexposed, the time required to readjust the X-ray source to a lower intensity is limited to no more than approximately one second.

Alternatively, the control signal can be derived from the brightnesses in the optical image on the exit window 6 instead of from the electronic image signal on the output of the image pick-up apparatus. Using a beam splitter 50, for example a splitting prism, a part of the light is guided from the exit screen to a photosensor 51 which converts the brightness values of the optical image into a photosignal which is applied to the exposure control circuit. The exposure control circuit derives the control signal from the photosignal in the same way as from the electronic image signal.

The comparator 23 applies the measuring part of the electronic image signal to an edge detector 34 which derives the location of a boundary between overexposed areas and remainder of the X-ray image from the image information in the measuring part. The edge detector 34 applies an edge signal representing said location to a beam diaphragm 12 in order to position a shutter of the beam diaphragm in such a manner that it intercepts X-rays which would reach the X-ray detector without attenuation and thus prevents unnecessary exposure of the patient to X-rays. The edge signal is applied to the image processing system 11 in order to adjust this system in such a manner that parts of the electronic image signal which correspond to overexposed areas are omitted or replaced by a neutral grey or color value.

We claim:

1. An X-ray examination apparatus, comprising:

an X-ray source for emitting an X-ray beam in order to form an X-ray image of an object, an X-ray detector for detecting the X-ray image and converting it into an electronic image signal, and an exposure control circuit for forming a control signal from the electronic image signal in order to adjust the X-ray source, wherein the exposure control circuit is arranged to determine a non-overexposed area of the X-ray image in which substantially all brightness values are lower than an upper limit value and to derive the control signal from the non-overexposed area while the X-ray source is emitting the X-ray beam.

2. An X-ray examination apparatus as claimed in claim 1, in which the X-ray detector comprises:

an X-ray image intensifier with an entrance screen and an exit window for converting the X-ray image on the entrance screen into an optical image on the exit window, and an image pick-up apparatus for deriving the electronic image signal from the optical image, and wherein the exposure control circuit is arranged to derive the control signal from an area of the optical image in which substantially no overexposure occurs.

3. An X-ray examination apparatus as claimed in claim 2, wherein the exposure control circuit comprises a selection unit for selecting a measuring part from the electronic image signal by selection of a part of the electronic image signal which has a signal level below a limit value.

4. An X-ray examination apparatus as claimed in claim 3, wherein the exposure control circuit comprises an averaging unit for determining a mean signal level of the measuring part, which averaging unit comprises an input which is coupled to an output of the selection unit, and an arithmetic unit for forming the control signal as a function of the difference between a reference value and said mean signal level.

5. An X-ray examination apparatus as claimed in claim 2, wherein the exposure control circuit comprises an edge detector for detecting an edge of the overexposed area and for supplying an edge signal which indicates the location of said edge in the X-ray image in order to control an image processing system for the processing of the electronic image signal and/or to control a beam diaphragm arranged between the X-ray source and the X-ray detector.

6. An X-ray examination apparatus as claimed in claim 1, wherein the exposure control circuit comprises a selection unit for selecting a measuring part from the electronic image signal by selection of a part of the electronic image signal which has a signal level below a limit value.

7. An X-ray examination apparatus as claimed in claim 6, wherein the exposure control circuit comprises an averaging unit for determining a mean signal level of the measuring part, which averaging unit comprises an input which is coupled to an output of the selection unit, and an arithmetic unit for forming the control signal as a function of the difference between a reference value and said mean signal level.

8. An X-ray examination apparatus as claimed in claim 7, wherein the exposure control circuit comprises an edge detector for detecting an edge of the overexposed area and for supplying an edge signal which indicates the location of said edge in the X-ray image in order to control an image processing system for the processing of the electronic image signal and/or to control a beam diaphragm arranged between the X-ray source and the X-ray detector.

9. An X-ray examination apparatus as claimed in claim 6, wherein the exposure control circuit comprises an edge detector for detecting an edge of the overexposed area and for supplying an edge signal which indicates the location of said edge in the X-ray image in order to control an image processing system for the processing of the electronic image signal and/or to control a beam diaphragm arranged between the X-ray source and the X-ray detector.

10. An X-ray examination apparatus as claimed in claim 1, wherein the exposure control circuit is arranged to determine the ratio of the surface area of the non-overexposed area to the surface area of the entire X-ray image, to compare said ratio with a boundary value, and to adjust the control signal to a value corresponding to a low brightness of the X-ray image if the fraction does not exceed the boundary value.

11. An X-ray examination apparatus as claimed in claim 1, wherein the exposure control circuit comprises an edge detector for detecting an edge of the overexposed area and for supplying an edge signal which indicates the location of said edge in the X-ray image in order to control an image processing system for the processing of the electronic image signal and/or to control a beam diaphragm arranged between the X-ray source and the X-ray detector.

12. A method for controlling, utilizing feedback, an X-ray source which irradiates an object, thus forming an X-ray image thereof, and an electronic image signal being formed from the X-ray image, and from the electronic image signal wherein while the object is being irradiated by the X-ray source a control signal for controlling the X-ray source is derived from an area of the X-ray image in which substantially all brightness values are lower than an upper limit value.

13. An X-ray examination apparatus, comprising:

an X-ray source for emitting an X-ray beam in order to form an X-ray image of an object, an X-ray detector for detecting the X-ray image and converting it into an electronic image signal, and an exposure control circuit for forming a control signal from the electronic image signal in order to adjust the X-ray source, wherein the exposure control circuit is arranged to determine a non-overexposed area of the X-ray image in which substantially all brightness values are lower than an upper limit value and to derive the control signal from the non-overexposed area and for individual settings of the X-ray apparatus the upper limit value equals an overexposure level minus a safety margin.

14. An X-ray examination apparatus as claimed in claim 13, wherein the exposure control circuit comprises an edge detector for detecting an edge of the overexposed area and for supplying an edge signal which indicates the location of said edge in the X-ray image in order to control an image processing system for the processing of the electronic image signal and/or to control a beam diaphragm arranged between the X-ray source and the X-ray detector.

15. An X-ray examination apparatus as claimed in claim 13 wherein the exposure control circuit comprises a selection unit for selecting a measuring part from the electronic image signal by selection of a part of the electronic image signal which has a signal level below a limit value.

16. An X-ray examination apparatus as claimed in claim 15, wherein the exposure control circuit comprises an averaging unit for determining a mean signal level of the measuring part, which averaging unit comprises an input which is coupled to an output of the selection unit, and an arithmetic unit for forming the control signal as a function of the difference between a reference value and said mean signal level.

17. An X-ray examination apparatus as claimed in claim 13, in which the X-ray detector comprises:

an X-ray image intensifier with an entrance screen and an exit window for converting the X-ray image on the entrance screen into an optical image on the exit window, and an image pick-up apparatus for deriving the electronic image signal from the optical image, and wherein the exposure control circuit is arranged to derive the control signal from an area of the optical image in which substantially no overexposure occurs.

18. An X-ray examination apparatus as claimed in claim 17, wherein the exposure control circuit comprises an edge detector for detecting an edge of the overexposed area and for supplying an edge signal which indicates the location of said edge in the X-ray image in order to control an image processing system for the processing of the electronic image signal and/or to control a beam diaphragm arranged between the X-ray source and the X-ray detector.

19. An X-ray examination apparatus as claimed in claim 17, wherein the exposure control circuit comprises a selection unit for selecting a measuring part from the electronic image signal by selection of a part of the electronic image signal which has a signal level below a limit value.

20. An X-ray examination apparatus as claimed in claim 19, wherein the exposure control circuit comprises an averaging unit for determining a mean signal level of the measuring part, which averaging unit comprises an input which is coupled to an output of the selection unit, and an arithmetic unit for forming the control signal as a function of the difference between a reference value and said mean signal level.

* * * * *